US006659182B1

(12) United States Patent
Saugier et al.

(10) Patent No.: US 6,659,182 B1
(45) Date of Patent: Dec. 9, 2003

(54) RETRIEVABLE SUCTION EMBEDMENT CHAMBER ASSEMBLY

(75) Inventors: Kent Saugier, Katy, TX (US); Bill G. Tompkins, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/193,609

(22) Filed: Jul. 11, 2002

(51) Int. Cl.[7] ..... E21B 29/12

(52) U.S. Cl. ..... 166/358; 166/381; 175/5; 175/10

(58) Field of Search ..... 166/358, 381; 175/5, 10; 405/227, 228

(56) References Cited

U.S. PATENT DOCUMENTS

| | | | | | |
|---|---|---|---|---|---|
| 3,352,357 | A | * | 11/1967 | Van Eek | 166/355 |
| 3,376,922 | A | * | 4/1968 | Leonhardt, Jr. | 166/358 |
| 3,426,844 | A | * | 2/1969 | McDaniel | 166/358 |
| 3,496,900 | A | * | 2/1970 | Mott et al. | 114/296 |
| 3,608,652 | A | * | 9/1971 | Medders et al. | 175/7 |
| 3,817,040 | A | | 6/1974 | Stevens | 61/53.5 |
| 4,138,199 | A | | 2/1979 | Gendron et al. | 405/232 |
| 4,238,166 | A | | 12/1980 | Gendron | 405/228 |
| 4,257,721 | A | | 3/1981 | Haynes | 405/227 |
| 4,318,641 | A | * | 3/1982 | Hogervorst | 405/224 |
| 4,367,800 | A | | 1/1983 | Arentsen | 173/127 |
| 4,544,041 | A | | 10/1985 | Rinaldi | 175/57 |
| 4,558,744 | A | * | 12/1985 | Gibb | 166/335 |
| 4,572,304 | A | * | 2/1986 | Mahar et al. | 175/5 |
| 4,575,282 | A | | 3/1986 | Pardue, Sr. et al. | 405/228 |
| 4,830,541 | A | | 5/1989 | Shatto | 405/226 |
| 5,090,485 | A | | 2/1992 | Pomonik et al. | 173/1 |
| 5,379,844 | A | * | 1/1995 | Glasscock et al. | 166/358 |
| 5,662,175 | A | | 9/1997 | Warrington et al. | 173/132 |
| 5,704,732 | A | | 1/1998 | Horton, III | 405/228 |
| 5,992,060 | A | | 11/1999 | Treu et al. | 37/345 |
| 6,129,487 | A | | 10/2000 | Bermingham et al. | 405/228 |
| 6,328,107 | B1 | * | 12/2001 | Maus | 166/335 |

* cited by examiner

*Primary Examiner*—Robert E. Pezzuto
*Assistant Examiner*—Thomas A. Beach
(74) *Attorney, Agent, or Firm*—Conley Rose, P.C.

(57) ABSTRACT

A method and apparatus for installing conductor casing for offshore oil wells. In the preferred embodiment of the present invention, a retrievable suction embedment chamber assembly drives a string of casing into the seafloor using hydrostatic pressure by releasably forming a seal around the casing to be driven and using a pump to lower the pressure inside the chamber. The assembly may then be flooded with seawater, released from the casing, then repositioned at a higher point on the casing, and the embedment process repeated. The assembly may also be used to embed several subsequent strings of casing in series.

15 Claims, 5 Drawing Sheets

RETRIEVABLE SUCTION EMBEDMENT CHAMBER ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to operations involving the drilling of wells in an offshore environment. In particular, the present invention relates to improved methods and an apparatus for installing conductor casing for offshore wells. More specifically, the present invention relates to method and apparatus for driving conductor casing into the seafloor using a retrievable suction embedment chamber assembly.

BACKGROUND OF THE INVENTION

Hydrocarbon reservoirs are found in special formations of rock usually located far underground. These reservoirs are exploited by drilling wells into the ground to facilitate the extraction of the hydrocarbons. As wells are drilled, many different formations of rock are encountered. Some of these formations are very hard, while others are loose or sandy. Shallow formations often contain water. In order to protect the integrity of the well as it is drilled, lengths of pipe, known as casing, are placed, or set, into the well. The casing acts as a barrier to prevent the sides of the well from caving in, to prevent the movement of fluid, like water or hydrocarbons, from one formation to another, and to increase efficiency of the well if it used to produce hydrocarbons.

A length of a casing is known as a string. A typical well will contain several strings of casing, each with a different diameter. The largest diameter casing will be at the top of the well with each successive casing string having a smaller diameter so that it can be moved through the casing already in the well. Conductor casing, also known as conductor pipe, is the largest diameter casing and therefore the first tubular placed when drilling a well. The purpose of the conductor casing is to prevent the loose, shallow formations from falling into the wellbore.

The diameter of the casing strings is determined by several factors including depth of the well and the type of formation being drilled in. As each string of casing is set, cement is pumped into the hole and around the outside of the casing to lock the casing in place and seal off the surrounding formation. When the well reaches the formations containing hydrocarbons, it is in effect a continuous, sealed conduit to the surface. Therefore, any hydrocarbons produced can not migrate into other formations or into ground water. Large valves, or pressure control equipment such as a blowout preventer or a production tree, are attached to the casing at the top of the well, known as the wellhead, to control the flow of material out of the well.

The formations of rock that contain hydrocarbons are found all over the world. Many of the recent efforts to find and produce these hydrocarbons have focused on formations located under water. In subsea wells, the conductor casing extends through an initial layer of mud and silt and provides a solid foundation for the well. The conductor casing is usually large diameter pipe ranging from 6 to 60 inches in diameter and can be several hundred feet long.

Early offshore wells were drilled in relatively shallow water a only few hundred feet deep. For wells drilled at these shallow depths, the conductor casing typically extends to the surface of the water and is attached to a platform. Conductor casing for these shallow water wells can be driven using equipment at the surface. For wells in deeper water, the conductor casing terminates at or near the seafloor. Because the conductor casing does not extend to the surface of the water, these deep-water wells require that the casing driving mechanisms be below the surface and typically at the seafloor. There are wells being drilled today in water depths up to two miles.

Prior art methods for installing conductor casing offshore include driving or hammering the conductor casing into the seafloor with a pile driver, rotary drilling with a drill bit to create a hole in the seafloor for the casing, and using high pressure liquids to wash, or jet, out a cavity in the seafloor for the casing. Prior art methods of installation require the heavy hoisting, rotary, or pumping equipment that can only be provided by the drilling vessel. The present invention overcomes these and other drawbacks of the prior art.

SUMMARY OF THE PREFERRED EMBODIMENTS

The embodiments of the present invention provide methods and apparatus for setting conductor casing for subsea wells using hydrostatic pressure as the driving force. The present invention allows conductor casing to be set more efficiently, and from smaller vessels, than the prior art methods. In one embodiment, a string of conductor casing is attached to a large chamber that is open at the base and substantially closed at the top. The conductor casing is placed through an opening in the top of the chamber and is attached to the chamber by an attachment mechanism which may be a ratcheting mechanism. The chamber is fitted with a device, such as a pump, for evacuating or filling the chamber from the top.

This assembly is lowered to the seafloor using a crane or winch mounted on a vessel. Once on the seafloor, the chamber is allowed to settle into the seafloor under its own weight, where the mud and silt of the seafloor create a seal around the base of the chamber. Once the assembly has settled into the seafloor, the pump is activated, and material, including water and mud, is pumped out of the chamber. As the pressure inside the chamber drops, the hydrostatic pressure operating on the outside of the chamber forces the chamber and the attached conductor casing into the seafloor.

When the chamber has moved as far into the seafloor as desired, the attachment mechanism can be released and water pumped into the chamber, creating a differential pressure that pushes the chamber out of the seafloor and toward the surface. Because the conductor casing is released from the chamber, the surface friction between the casing and the mud will hold the casing in place. In one embodiment, the chamber is moved up the casing and the attachment mechanism is re-engaged. The pump is reversed, lowering the pressure inside the chamber, and the chamber is again forced into the seafloor, pulling the casing with it. This sequence can be repeated until the casing reaches the desired depth. Once the casing reaches the desired depth, the attachment mechanism can be disengaged and the chamber moved free of the seafloor, where it can be retrieved to the surface or used to place additional strings of conductor casing.

The only equipment required to operate the above described embodiment is a lifting device, such as a crane or a winch, and a power supply to the pump and attachment mechanism. This equipment is typically available on many vessels that service the offshore petroleum industry. This allows flexibility in choosing the most economical vessel to use to set conductor casing.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
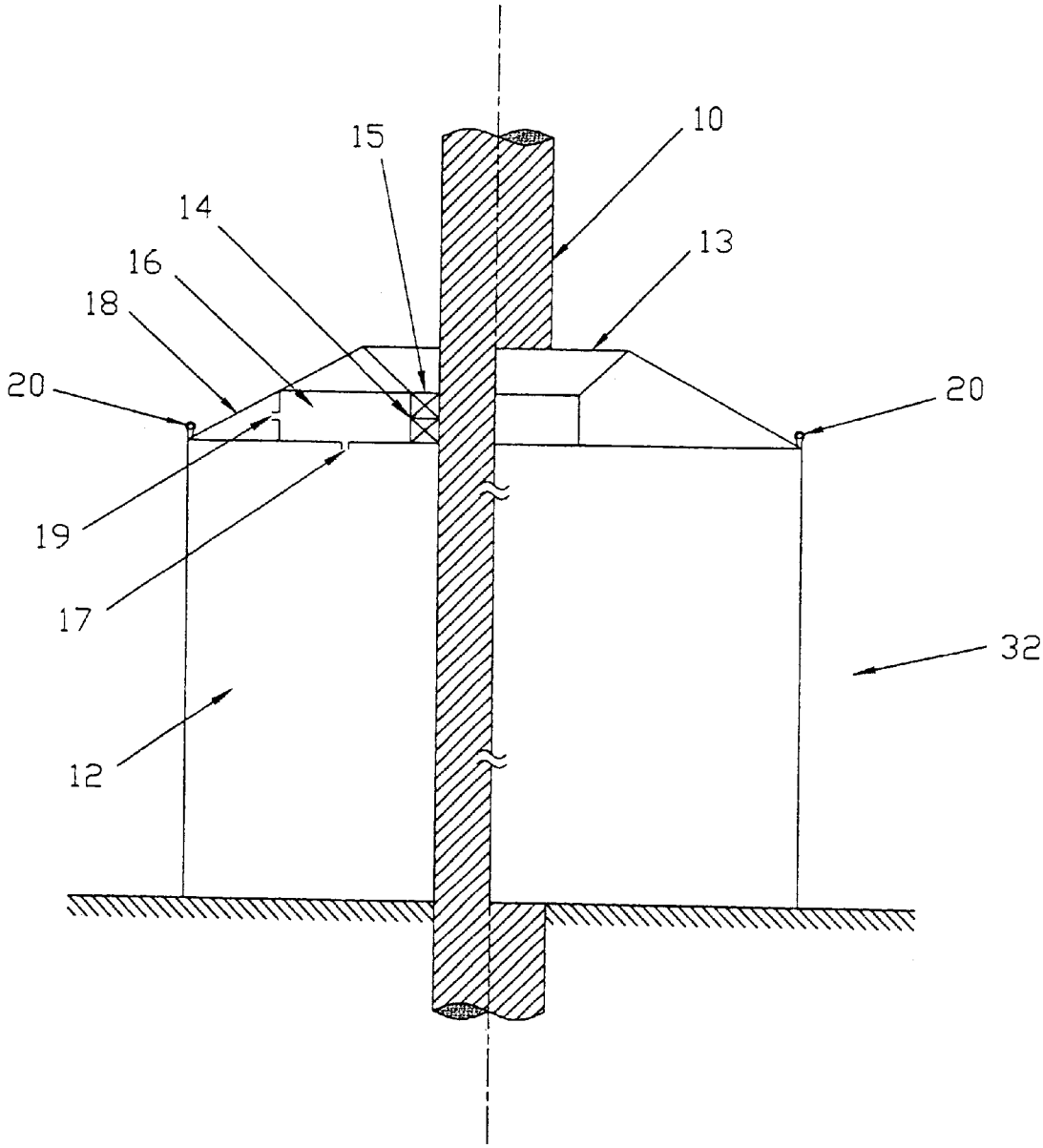
FIG. 1 is a partial sectional side view with section of a retrievable suction embedment chamber assembly.

Referring to the drawings, FIG. 1 represents a side view of one embodiment of an assembly 32 for installing conductor casing 10, generally including a body comprising a suction embedment chamber 12, an attachment mechanism 15 located in the assembly throat 14, a pumping system 16, and lift points 20. Assembly 32 may optionally include chamber protection plating 18 or platforms and mounting assemblies (not shown) enabling the assembly to serve as a subsea template for drilling and production. The pumping system 16 may be placed more from chamber 12, such as on a surface facility (not shown), with hydraulic lines to and from the chamber or attached directly to the chamber. Assembly 32 also comprises a control system (not shown) in communication with attachment mechanism 15 and pumping system 16. The control system may be of any suitable type, including electrical, mechanical, or multiplexed, and is preferably located at the surface with control signals transmitted down to assembly 32.

The suction embedment chamber 12 is a chamber open at the base and substantially closeable at the top. The top of chamber 12 is equipped with an opening 13 to accommodate conductor casing 10 and at least one other opening 17 to provide a conduit for a pump 16. One preferred embodiment of the present invention includes a cylindrical chamber with a flat top, constructed so that it can withstand external pressure without any internal bracing. It is envisioned that a typical chamber 12 would be at least 12–30 feet in diameter and 25–100 feet tall. Chamber 12 is preferably constructed out of steel, but other materials, such as other metals or composites, can be used. One of ordinary skill in the art will recognize that any number of chamber designs may be suitable, including a three-chamber design for level-critical applications.

Figure 2B:
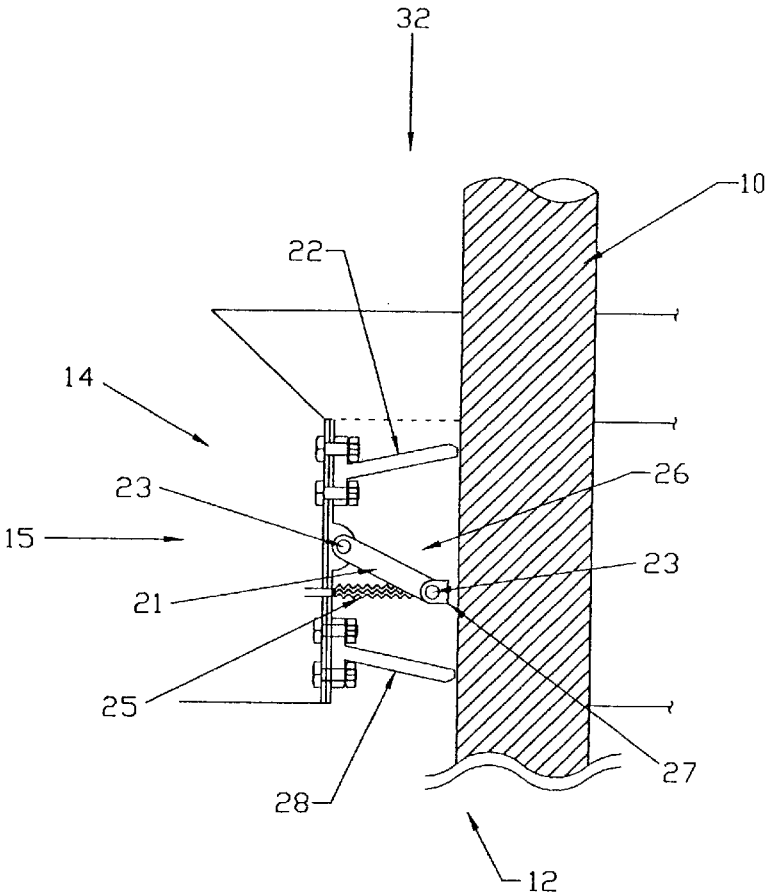
FIG. 2B is a cross-sectional view of the chamber throat with a double-action hydraulic grip.
Figure 2A:
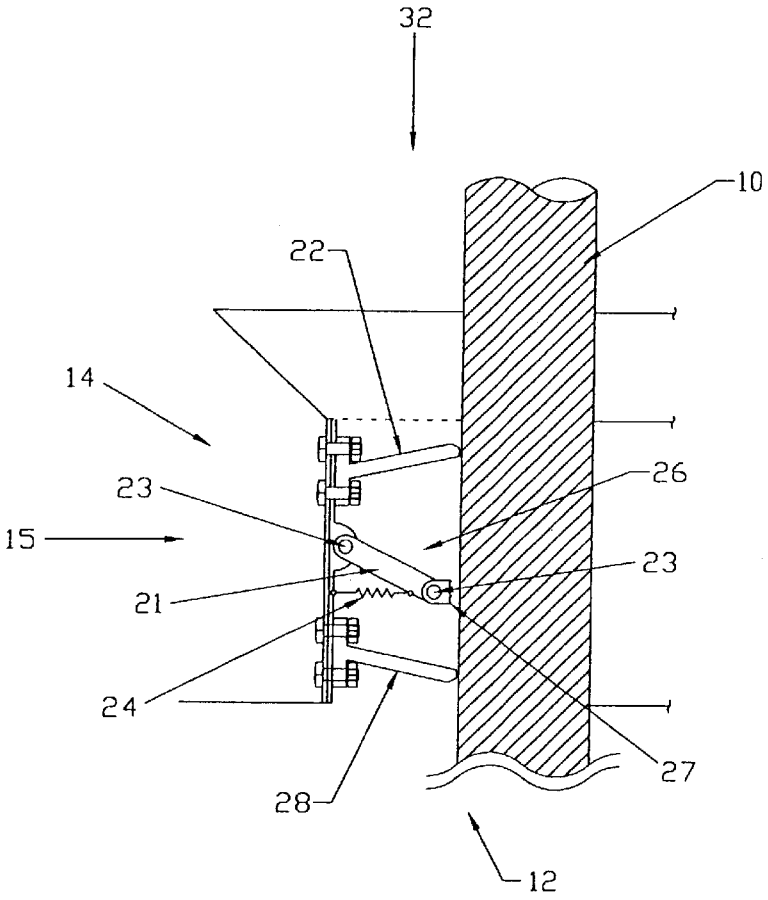
FIG. 2A is a cross-sectional view of the chamber throat with single-action spring grip.

Attachment mechanism 15, embodiments of which are shown in FIGS. 2A and 2B, is located in throat 14 of chamber 12 and comprises a releasable gripping mechanism 26 and seals 22 and 28 between assembly 32 and conductor casing 10. Attachment mechanism 15 comprises a suction seal 22, a pressure seal 28, and a gripping mechanism 26. Gripping mechanism 26 comprises a bar 21 with pivots 23 at either end, and a gripping head 27 attached to the pivot 23 closest to casing 10, and either a single-acting grip positioner 24, as shown in FIG. 2A, or a double-acting grip positioner 25, as shown in FIG. 2B. Critical parts or the entire attachment mechanism 15 may be replaceable.

Depending on the soil shear strength and the crush-resistant features of casing 10, the appropriate applicable gripping mechanism 26 may be selected. Single-acting mechanism 24 is spring loaded, causing gripping head 27 to adhere to the surface of casing 10. Gripping mechanism 26 will grip casing 10 due to spring pressure and an angular resistance to relative casing motion. Double-acting mechanism 25 is a sealed diaphragm wherein the internal pressure can be changed to adjust the grip pressure.

Figure 3B:
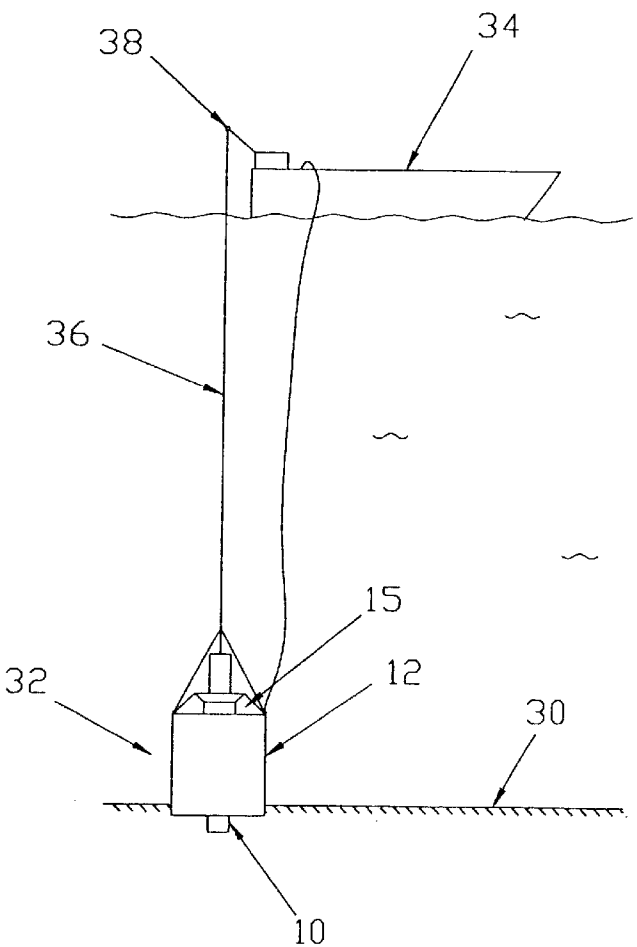
FIG. 3B is a side view of the assembly and casing during casing embedding operation.
Figure 3A:
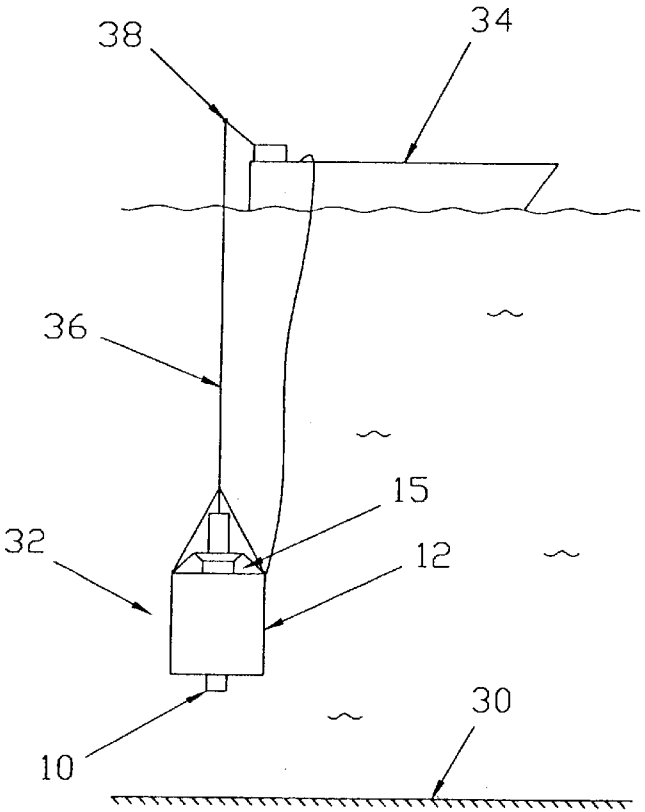
FIG. 3A is a side view of the assembly and casing during positioning.

The method for installing the conductor casing 10 is detailed in FIGS. 3A–3D. As shown in FIG. 3A, the suction embedment chamber assembly 32 and conductor casing 10 are transported to the well site by a vessel 34. Conductor casing 10 is affixed to the assembly 32 by attachment mechanism 15 so that conductor casing 10 protrudes from the top of assembly 32, which is supported by any suitable lowering mechanism. For example, assembly 32 may be attached by a reelable cable 36 to a winch 38 located on vessel 34. As casing 10 and assembly 32 are lowered to seafloor 30, some air preferably is retained in chamber 12 so as to provide a degree of buoyancy and thereby offset the weight of assembly 32.

When assembly 32 lands on seafloor 30, as shown in FIG. 3B, any remaining air is released, and assembly 32 is allowed to sink into seafloor 30 under its own weight. The base of assembly 32 sinking into seafloor 30 creates a seal around the outside of chamber 12. The pumping system (not shown) is then activated and removes water and particulate material from inside chamber 12. This creates differential pressure acting on the outside of chamber 12, which forces assembly 32 into the seafloor 30. Attachment mechanism 15 maintains the physical connection between conductor casing 10 and chamber 12 so that casing 10 is driven into the seafloor 30 along with assembly 32. When assembly 32 reaches maximum penetration into the seafloor 30, as shown in FIG. 3C, attachment mechanism 15 releases casing 10, and pumping system 16 is reversed.

Figure 3D:
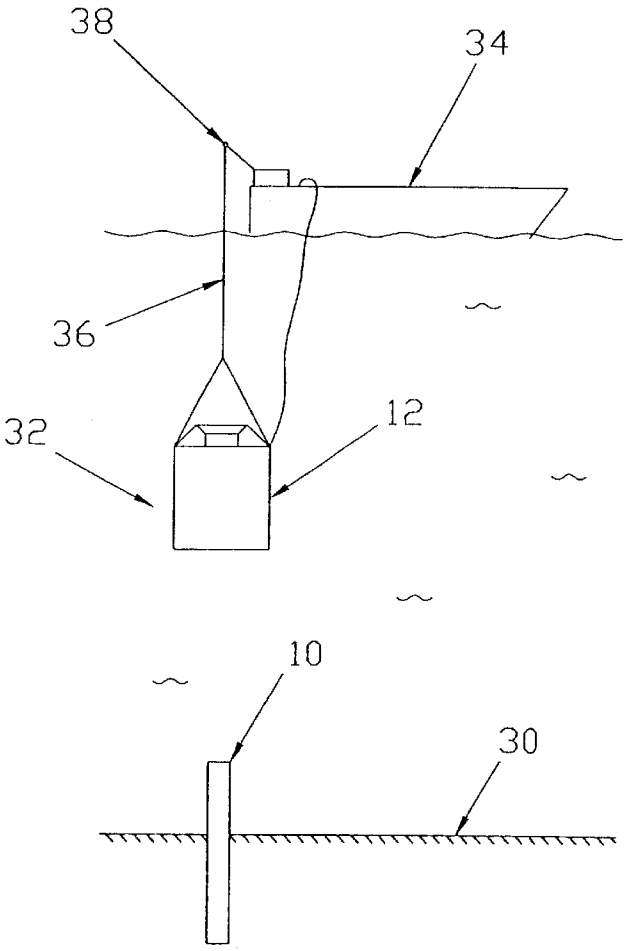
FIG. 3D is a side view of the assembly and casing during assembly retrieval.
Figure 3C:
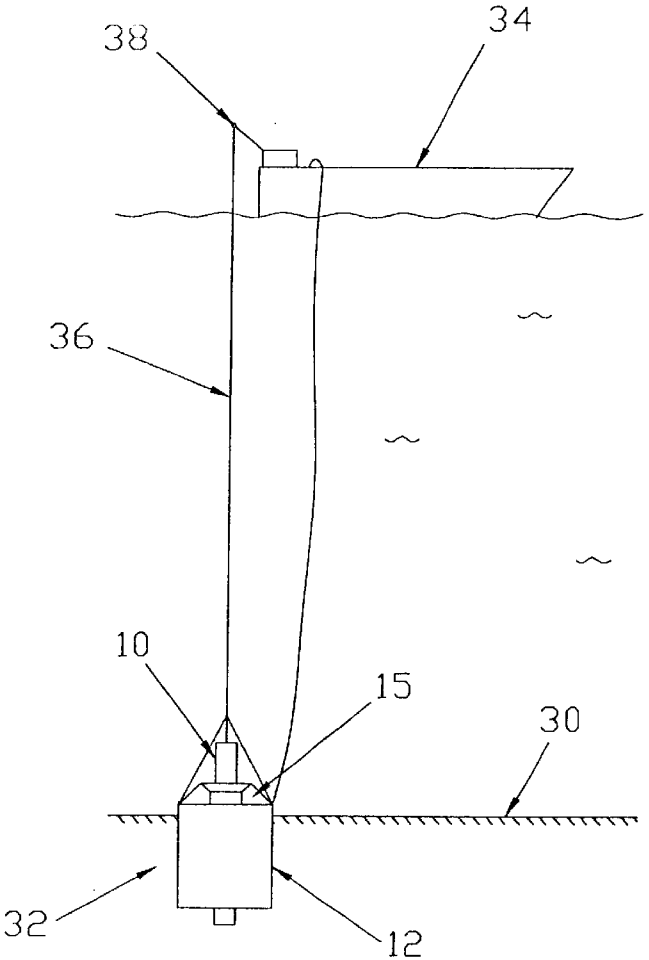
FIG. 3C is a side view if the assembly and casing at the point of maximum seafloor penetration.

Pumping water into chamber 12 raises assembly 32 while conductor casing 10 remains in place, as shown in FIG. 3D. When assembly 32 rises relative to seafloor 30, attachment mechanism 15 can be re-engaged and pumping system 16 activated to again lower the pressure inside chamber 12 and continue advancing conductor casing 10 deeper into seafloor 30. These steps can be repeated until casing 10 reaches the intended depth. When the intended depth has been reached, attachment mechanism 15 is released and pumping system 16 is again reversed to raise assembly 32 out of the seafloor 30, so that it can be recovered and used again.

Referring briefly back to FIG. 1, pumping system 16 generally comprises at least one conduit 17 to the interior of chamber 12, at least one pump (not shown), and at least one conduit 19 to the sea. Preferably, pumping system 16 is reversible, so that it can be used for both the evacuation and filling of chamber 12. A preferred embodiment of pumping system 16 is to mount a single, reversible pump on the chamber 12 and control its operation from the surface through hydraulic, electric, or pneumatic controls. Another embodiment would be to mount the pump at the surface and attach it to chamber 12 through a riser or flexible conduit. One of ordinary skill in the art would recognize other pumping mechanisms including systems with multiple pumps or conduits.

Assembly 32 may also include modular platforms (not shown) that can be attached to chamber 12. It is envisioned that the platforms can be used to support other subsea well equipment such as the wellhead, guidance structures, mud tanks, mud pumps, and process and drilling equipment. When equipped with the platforms, chamber 12 would preferably be left in place on the seafloor to serve as reinforcement of the wellhead and as support for wellhead or other subsea equipment.

This installation method may depend on the bearing and shear properties of the soil. The soil usually found on seafloor 30, especially in deep water, is of a thick, soupy consistency. The bearing strength of the soil is such that the weight of assembly 32 is sufficient to push the assembly 32 a certain distance into seafloor 30. At that point, due to the nature of the soil, a seal is formed around the perimeter of chamber 12.

The installation method works on the principle that the force available to drive conductor casing 10 and chamber 12 into seafloor 30 is greater than the force required to shear the soil. The driving force is the difference between the pressure on the outside of chamber 12 and the pressure inside of chamber 12 multiplied times the area of the top of chamber 12. The resisting force is created by friction between the soil and the sides of chamber 12 and casing 10. The resisting force is approximately the total soil shear force required to shear the inside and outside surface areas of chamber 12 and conductor casing 10. Chamber 12 and pumping system 16 are designed so that an adequate pressure differential can be maintained so that the hydrostatic pressure will provide adequate force to drive casing 10 into seafloor 30.

A key advantage of the present invention is that, unlike prior art suction embedment systems, a penetration is provided through suction chamber 12, allowing conductor casing 10 to be driven into the seafloor 30. As assembly 32 is able to attach to and release conductor casing 10 subsea, assembly 32 may be retrieved and reused. Attachment mechanism 15 also enables assembly 32 to be used with a string of casing much longer than assembly 32, because it can be detached and reattached at a higher point on the casing string.

Figure 4C:
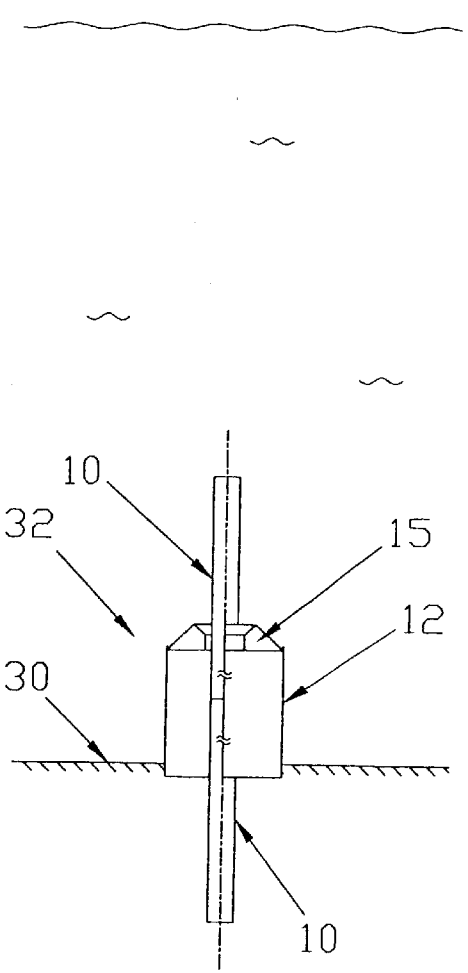
FIG. 4C is a side view with section of the assembly and an embedded first casing mated to a subsequent casing.
Figure 4B:
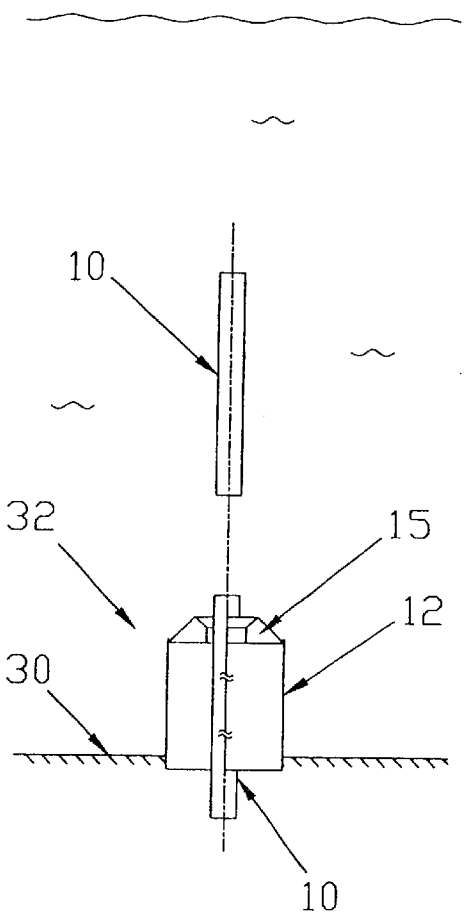
FIG. 4B is a side view with section of the assembly and an embedded first casing with a lowered subsequent casing.
Figure 4A:
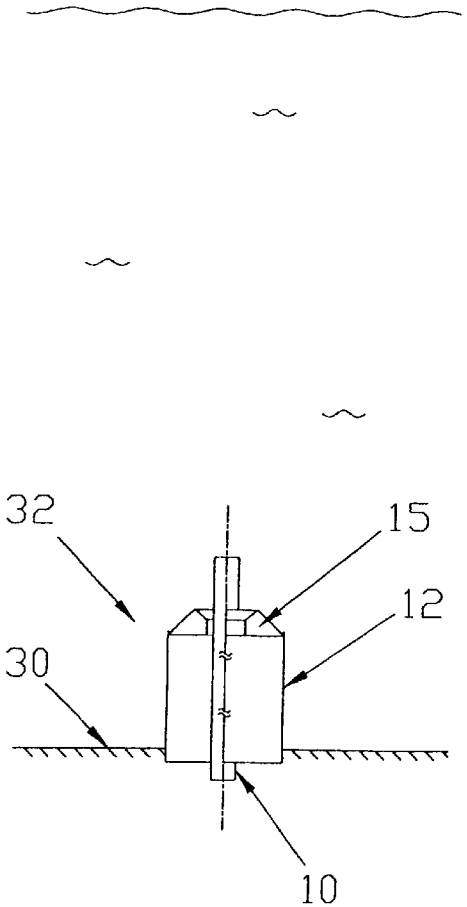
FIG. 4A is a side view with section of the assembly and a first casing.

Also, if additional strings of conductor casing 10 are required, they can be lowered from the surface and attached inline by attachment mechanism 15 to assembly 32, as shown in FIGS. 4A–4C. As shown in FIG. 4A, a first string of casing 10 is driven into seafloor 30 by assembly 32. FIG. 4B shows casing string 10 driven deeper into seafloor 30, in preparation for mating with a subsequent string of casing 10. The subsequent string of casing 10 can be mated to the original string 10 using an in-place torquing device (not shown) or, in the case of relatively shallow water depths, torqued from the surface. Once mated, pumping system 16 may be reversed and attachment mechanism 15 released to raise assembly 32 up mated casing strings 10. Once at the desired height, attachment mechanism 15 may grasp the mated casings 10 and pumping system 16 engaged in order to drive mated casings 10 down deeper into seafloor 30. These steps can be repeated until casing 10 has reached the intended depth. After casing 10 is set, assembly 32 can be retrieved to the surface and reused.

The embodiments set forth herein are merely illustrative and do not limit the scope of the invention of the details therein. It will be appreciated that many other modifications and improvements to the disclosure herein may be made without departing from the scope of the invention of the inventive concepts disclosed herein. As many varying and different embodiments may be made within the scope of the inventive concept taught herein, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. An assembly for embedding a casing, comprising:

a body defining a chamber, said chamber having a substantially open base and a substantially closed top, said top including an opening therethrough;

a releasable attachment mechanism positioned at said opening; said attachment mechanism receiving the casing such that the casing extends through said chamber top and into said chamber;

a pumping system in fluid communication with said chamber.

2. The assembly according to claim 1 further comprising a control system in communication with said attachment mechanism and said pump.

3. An assembly for embedding a casing, comprising:

a body defining a chamber, said chamber having a substantially open base and a substantially closed top, said top including an opening therethrough;

a releasable attachment mechanism positioned at said opening; said attachment mechanism sized and configured to receive the casing such that the casing extends through said chamber top;

a pumping system in fluid communication with said chamber;

said attachment mechanism forming a seal around the casing.

4. The assembly according to claim 1 wherein said chamber is substantially cylindrical.

5. An assembly for embedding a casing, comprising:

a body defining a chamber, said chamber having a substantially open base and a substantially closed top, said top including an opening therethrough;

a releasable attachment mechanism positioned at said opening; said attachment mechanism receiving the casing such that the casing extends through said chamber top;

a pumping system in fluid communication with said chamber;

said releasable attachment mechanism comprising a suction seal, a gripping mechanism, a pressure seal, and a grip positioner.

6. An assembly for embedding a casing, comprising:

a body defining a chamber, said chamber having a substantially open base and a substantially closed top, said top including an opening therethrough;

a releasable attachment mechanism positioned at said opening; said attachment mechanism receiving the casing such that the casing extends through said chamber top;

a pumping system in fluid communication with said chamber;

said pumping system comprising at least one conduit attached to said chamber, at least one pump, and at least one conduit to the sea.

7. The pumping system according to claim 6 wherein said pump is a reversible pump.

8. The pumping system according to claim 6 wherein said pump is mounted on said chamber.

9. The pumping system according to claim 6 wherein said pump is mounted on board a vessel.

10. An assembly for embedding a casing, comprising:

a body defining a chamber, said chamber having a substantially open base and a substantially closed top, said top including an opening therethrough;

a releasable attachment mechanism positioned at said opening; said attachment mechanism receiving the casing such that the casing extends through said chamber top;

a pumping system in fluid communication with said chamber;

said assembly further comprising at least one platform mounted on the exterior of said chamber.

11. A method for installing a casing in the seafloor, comprising the steps of:

(a) providing a body defining a chamber having an open bottom and a substantially closed top, the top including a releasable sealing mechanism for engaging the casing;

(b) engaging the casing with the releasable sealing mechanism;

(c) lowering the body and the casing to the seafloor and removing air from the chamber so as to allow the chamber to sink into the seafloor;

(d) lowering the pressure in the chamber such that hydrostatic pressure causes the body to advance into the seafloor; and (e) releasing the releasable sealing mechanism and increasing the pressure in the chamber so as to raise the body relative to the seafloor.

12. The method according to claim 11 wherein steps (b), (d) and (e) are repeated until said casing reaches the desired depth.

13. A method for installing a plurality of lengths of cylindrical casing in the seafloor comprising the steps of:

(a) installing a first length of casing into a chamber through an attachment mechanism;

(b) lowering the chamber to the seafloor and removing the air from the chamber allowing said chamber to sink into the seafloor;

(c) evacuating the interior of the chamber by way of a pumping mechanism so that hydrostatic pressure will push the chamber and therefore the casing into the seafloor until the chamber reaches the maximum desired penetration depth;

(d) releasing the attachment mechanism and reversing the pumping mechanism, filling interior of the chamber, so as to raise the chamber;

(e) engaging said attachment mechanism and reversing said pumping mechanism to drive said chamber and said casing into the seafloor;

(f) repeating steps (c) through (e) until said first casing length reaches the desired depth;

(g) releasing the attachment mechanism and reversing the pumping mechanism in order to raise said chamber;

(h) lowering a subsequent length of casing from the surface and attaching it to the chamber and the first length of casing; and (i) repeating steps (c) through (h) until the casing reaches the desired depth.

14. The method according to claim 13 further comprising the steps of releasing the attachment mechanism, pumping the assembly out of the seafloor, and hoisting the assembly to the surface.

15. The method according to claim 12 further comprising the step of disconnecting the cable and control lines and leaving the assembly substantially embedded in the seafloor.

* * * * *